US005666996A

United States Patent [19]

Bollier et al.

[11] Patent Number: 5,666,996

[45] Date of Patent: Sep. 16, 1997

[54] FORCED AIR CLEANING SYSTEM FOR TEXTILE MACHINES

[75] Inventors: Walter Bollier, Adliswil; Arnold Keller, Stallikon, both of Switzerland

[73] Assignee: Luwa AG, Zurich, Switzerland

[21] Appl. No.: 356,219

[22] PCT Filed: Apr. 6, 1994

[86] PCT No.: PCT/CH94/00069

§ 371 Date: Dec. 16, 1994

§ 102(e) Date: Dec. 16, 1994

[87] PCT Pub. No.: WO94/24350

PCT Pub. Date: Oct. 27, 1994

[30] Foreign Application Priority Data

Apr. 16, 1993 [CH] Switzerland ..... 01 169/93-7

[51] Int. Cl.[6] ..... D03J 1/00; D01H 11/00; B08B 5/00

[52] U.S. Cl. ..... 139/1 C; 15/312.1; 15/345; 104/173.1

[58] Field of Search ..... 19/65 A; 15/345, 15/312.1, 319; 104/173.1; 139/1 C; 57/304–306

[56] References Cited

U.S. PATENT DOCUMENTS

| | | | |
|---|---|---|---|
| 3,153,803 | 10/1964 | Bahnson, Jr. | 15/312.1 |
| 3,376,596 | 4/1968 | Duncan | 15/312.1 |
| 3,440,097 | 4/1969 | Gleaton | 15/312.1 |
| 3,762,143 | 10/1973 | Stewart | 57/304 |
| 4,768,443 | 9/1988 | Bruggisser et al. . | |
| 4,869,296 | 9/1989 | Shaw | 139/1 C |
| 4,895,186 | 1/1990 | Shaw | 139/1 C |
| 5,008,972 | 4/1991 | Steinke | 139/1 C |
| 5,353,467 | 10/1994 | Junger | 139/1 C |
| 5,361,572 | 11/1994 | Uematsu et al. | 57/306 |
| 5,472,018 | 12/1995 | Vemer et al. . | |

FOREIGN PATENT DOCUMENTS

| | | |
|---|---|---|
| 291485 | 11/1988 | European Pat. Off. . |
| 1205920 | 11/1965 | Germany . |
| 1018718 | 2/1966 | United Kingdom . |
| 93 6281 | 4/1993 | WIPO . |

OTHER PUBLICATIONS

Bollier, et al: "Wirtschaftliches Weben durch Milroklimatisierung in Webbereich", Melliand Textilberichte, Bd.74, Nr.11, Nov. 1993, Heidelberg, Germany, pp. 1107–1111. Untranslated.

*Primary Examiner*—Andy Falik
*Attorney, Agent, or Firm*—Cushman, Darby & Cushman IP Group of Pillsbury Madison & Sutro LLP

[57] ABSTRACT

An air channel extends parallel to and underneath the straight runway of a travelling cleaner, and the runway and air channel extend above a row of weaving machines. Provided above each weaving machine on the underside of the air channel is a downward-directed piston-flow outlet which is supplied with suitably conditioned air by the air channel. Provided in the floor underneath each weaving machine is an air outlet which is connected to a suction channel. Via an air-treatment system, the air returned from the suction channel, after being filtered and conditioned as necessary, is fed into the air channel again. The air channel and the runway extend in parallel relation with respect to each other, form a unit, and are jointly supported.

21 Claims, 4 Drawing Sheets

FORCED AIR CLEANING SYSTEM FOR TEXTILE MACHINES

BACKGROUND OF THE INVENTION

The invention relates to an apparatus for removing dust, lint, and other waste products from textile machines.

On textile machines, it has already been customary for a long time to employ travelling cleaners, by means of which the fabricating stations of the textile machines are swept by blowing-air and/or suction-air streams, in order to keep freed lint and dust away from the fabricated fiber material or thread material or to reduce its precipitation on the machine.

At the same time, devices, in which the travelling cleaners move on a runway past a plurality of textile machines swept in succession, have also already become known. In these, the runway is usually supported on the machines themselves or on the floor by means of pillars.

The examination of yarns and fabrics has shown that these have an astonishingly high content of lint and dust. Thread breaks occur relatively frequently in the textile fabrication processes themselves, these being attributable, among other things, to the high content of impurities in the ambient air or to accumulations of impurities at fabricating stations.

SUMMARY OF THE INVENTION

The object of the invention is, therefore, to provide an apparatus, by means of which the impurities can be markedly reduced, at all events in the critical fabrication regions, at comparatively low investment costs.

This object is achieved, according to the invention, by means of a traveling cleaner, moving on a runway wherein there extends parallel to the runway an air channel which supplies at each textile machine a downwardly directed piston flow outlet, the air channel being connected to an air treatment system, and exhaust ports connected to a suction channel and arranged in the floor.

As a result of the cooperation of a controlled piston flow flowing continuously through the fabrication zones of all the machines with a travelling cleaner passing periodically in the vicinity of the fabrication zones, a marked reduction in the number of thread breaks and an improvement in the quality of the fabricated textile material are achieved. This is attained because the work zone is kept virtually free of dust by means of the displacement flow and because the risk of accumulations of impurities on machine parts critical for fabrication is avoided by means of the travelling cleaner. Because the air channel runs parallel to the runway of the travelling cleaner, straight paths are obtained both for the flow and for the movement of the travelling cleaner and intersection problems can be avoided.

Further advantages of the apparatus according to the invention and preferred embodiments of the invention are described further below.

DESCRIPTION OF THE DRAWINGS

The apparatus according to the invention is explained in more detail below by means of exemplary embodiments with reference to the drawing. In this.

PREFERRED EMBODIMENTS

Figure 2:
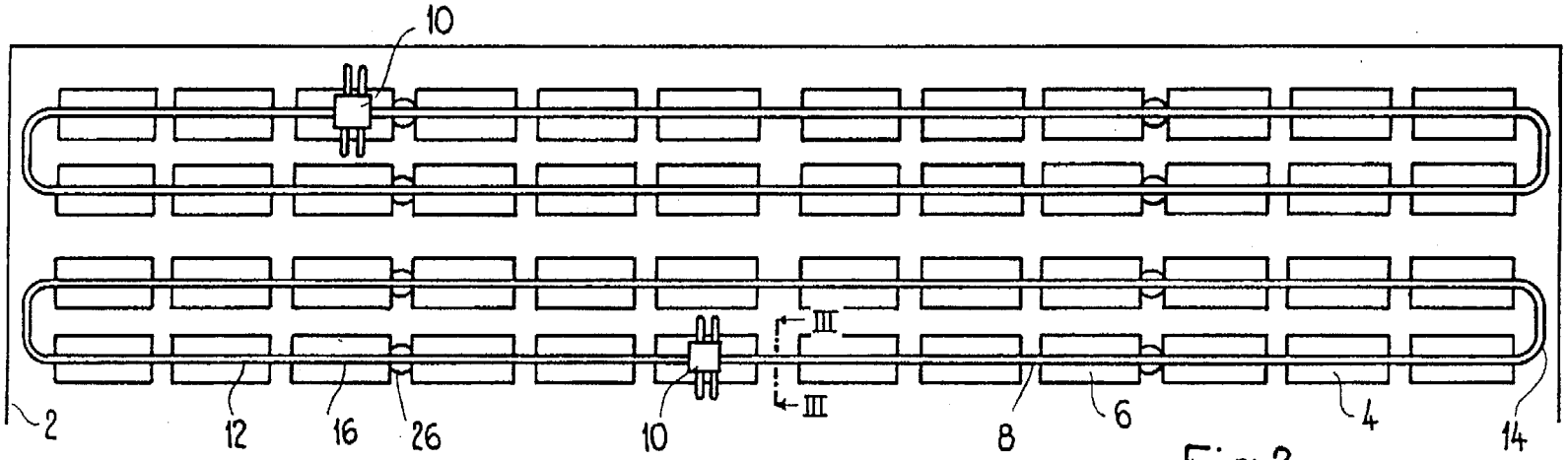
FIG. 2 shows a plan view of the apparatus according to FIG. 1.
Figure 1:
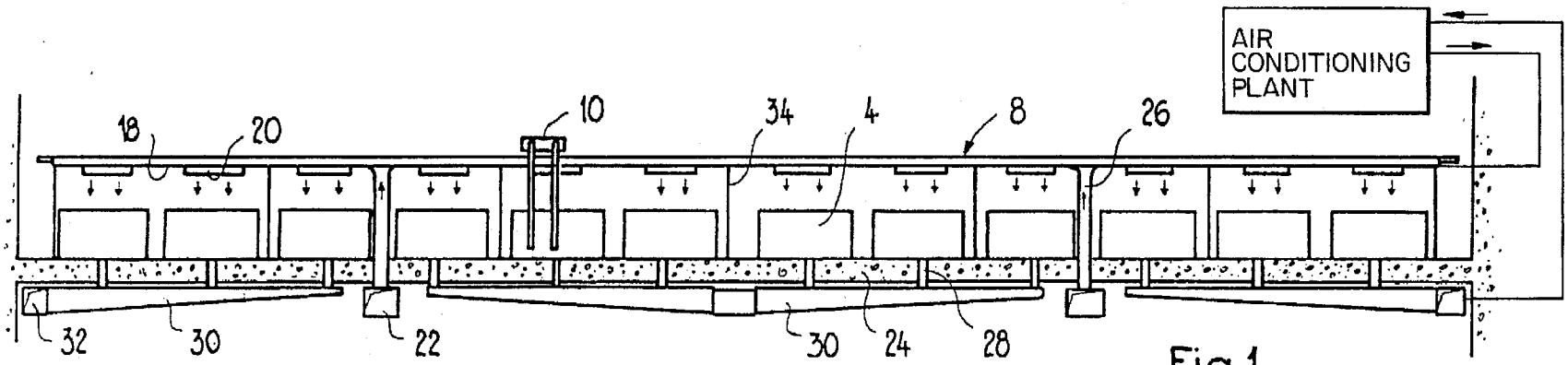
FIG. 1 shows a side elevational view partially in section of a first exemplary embodiment of an apparatus for a textile-machine room.

As is shown in FIGS. 1 and 2, weaving machines 4 are arranged in a plurality of parallel rows 6 in a weaving room 2. A runway 8, closed on itself, of a travelling cleaner 10 known in the art extends over every two directly adjacent rows 6. The runway 8 has, in addition to straight parts 12 parallel to the rows 6, arcuate parts 14 connecting the parts 12 to one another.

Air channels 16 extend parallel to the straight parts 12 of the runway 8 above the rows 6 of weaving machines 4. A downward-directed piston-flow outlet 20 is provided above each weaving machine 4 on the undersides 18 of the air channels 16. By a piston-flow outlet is meant, in the present connection, an outlet which generates a piston-like displacement flow with an approximately uniform distribution and an approximately uniform velocity. With suitable outflow velocities of, for example, between 0.3 and 1.2 m/sec, an at least low-turbulence flow is then obtained. Suitable outlets of this type are described as local outlets in Swiss Patent CH 684 101 A5, or its U.S. Pat. No. 5,472,018, both in terms of constructive design and in terms of the spatial arrangement or position above a weaving machine. However, other designs of such outlets are also possible.

Two distributor channels 22, which extend at a distance from, but parallel to one another, under the floor 24 of the weaving-machine room 2, are connected to each of the air channels 16 via riser pipes 26. The two distributor channels 22 are connected to a common air-conditioning, or air-treatment, plant as shown in FIG. 1. The outlets 20 are supplied with air of usually high moisture content via the distributor channels 22, the riser pipes 26 and the air channels 16. Since each of the air channels 16 is fed with air from the distributor channels 22 at two points located at a distance from one another, a uniform supply of all the piston-flow outlets is possible by means of a relatively small channel cross-section.

The floor 24 has at least one exhaust-air port 28 underneath each weaving machine 4. A plurality of exhaust-air ports 28 are respectively connected to the air-conditioning plant via collecting conduits 30 and suction channels 32. By means of the exhaust-air ports 28, essentially the air coming from the piston-flow outlets 20 is discharged from the weaving-machine room 2 after it has performed its function. In the case of a plurality of exhaust-air ports for each machine, it is expedient to provide at least one each for the discharge of the lint and dust delivered by the travelling cleaner.

It remains to be added that, in general terms, the air channels 16 and the straight runway parts 12 are preferably supported jointly. As regards the exemplary embodiment described here, the support on the floor 24 takes place via a plurality of supporting columns 34 arranged in pairs and distributed between the weaving machines 4.

Particularly when the machine rows are short, that is to say a comparatively small number of machines is arranged in each row, it can also be expedient to provide the support of the runway and of the air channel on the room ceiling and to carry out the feed of the air channel from the ends of the rows. In such a case, a back and forth movement on a straight path is to be provided for the travelling cleaner.

Figure 3:
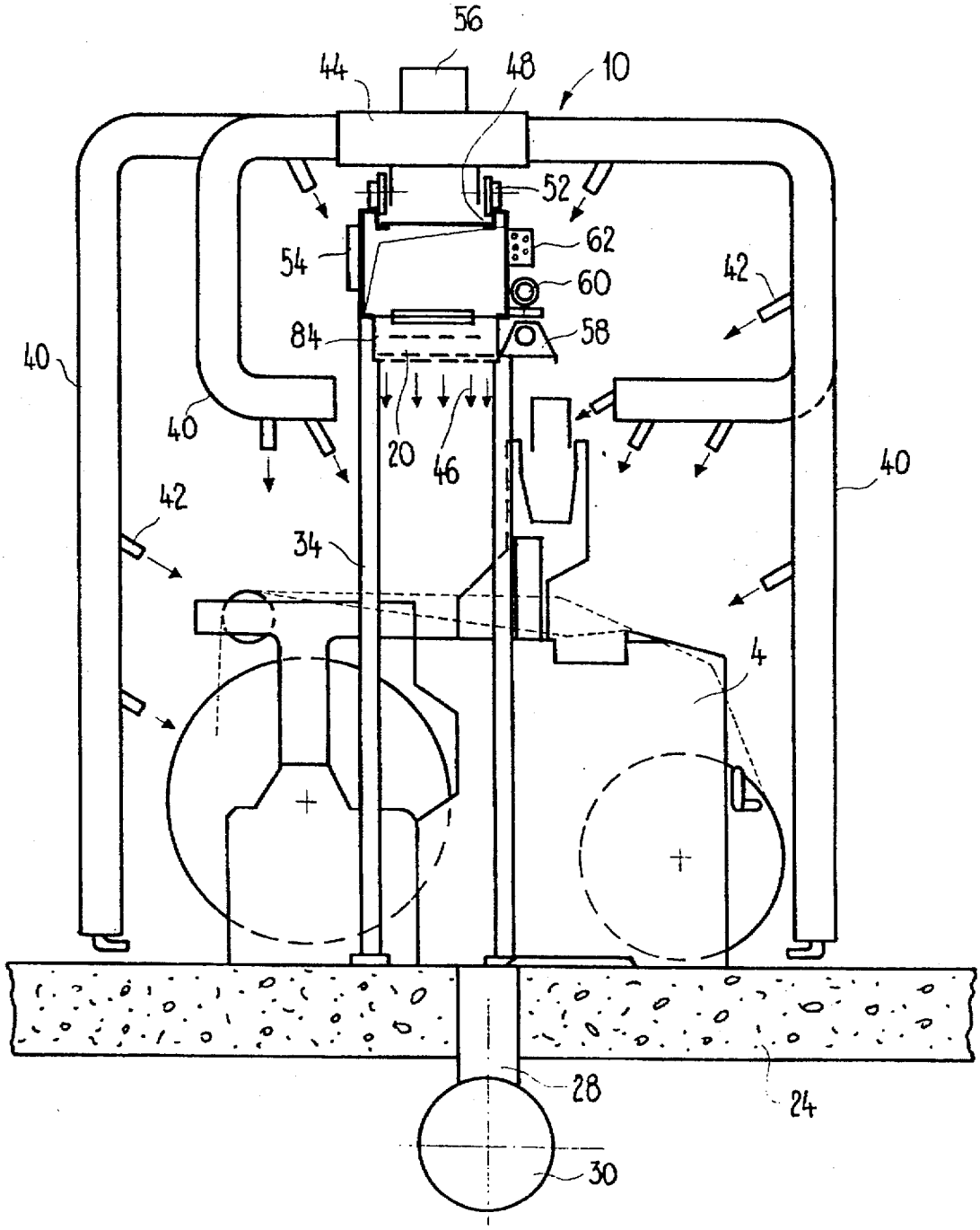
FIG. 3 shows a vertical section along the line III—III in FIG. 2.

As is shown in FIG. 3 the piston-flow outlet 20 is provided on an outlet box 84 mounted on the air channel 16. Furthermore, the travelling cleaner 10 has a plurality of pipe arms 40 equipped with blowing nozzles 42. A fan 44 supplies the blowing nozzles 42 with sucked-up room air via the pipe arms 40 connected to these. The blowing nozzles 42 are oriented in such a way that, during the passage of the travelling cleaner, they sweep over parts of the weaving machine 4 with corresponding air streams on both sides of the displacement flow emerging from the piston-flow outlet 20 and indicated at 46.

Accordingly, each weaving machine 4 is simultaneously cleaned by two independent air supplies directed at the machine. The first air supply, indicated at 46, carried by air channel 16, is directed at the machine from above by piston-flow outlet 20. The second air supply, generated by fan 44 which travels with traveling cleaner 10 is directed at different locations on the weaving machine 4 by pipe arms 40 and nozzles 42, which also travel with traveling cleaner 10.

Two rails, formed by the air channel 16 itself and defining the straight part 12 of the runway 8 of the travelling cleaner 10, are shown at 48. Reference number 52 denotes rubbing rollers which form a running gear for the travelling cleaner 10 and at least one of which is driven by an electric motor (not shown) forming the travelling drive. A busbar 54 is fastened to one of the side walls of the air channel 16. A wiper set (not shown) fastened to the travelling cleaner 10 is in permanent contact with the busbar 54. The wiper set is itself electrically connected conductively to the electric motor of the travelling drive and to an electric motor 56 that drives of the fan 44.

Moreover, the air channel 16 serves as a carrier for light fixtures 58, for a compressed-air conduit 60 connected to all the weaving machines of the same row 6 and for a cable duct 62 for supplying current to the weaving machines 4 of the row 6.

The exemplary embodiment according to FIG. 4 differs from that according to FIGS. 1 to 3 mainly in that the vertical position of the below-described apparatus parts can be designed independently of one another. Specifically, the air channel designated here by 116 is at a distance from the runway 108 and is arranged to extend underneath the latter. Instead of the supporting columns 34, one column for the air channel 116 and a further column for the runway 108 can be provided respectively here. However, it is usually expedient to carry out the support of both of these elements by means of a respective common stay 134.

Furthermore, the air channel 116 is connected to the piston-flow outlets 120 via connection pieces 170. These outlets can therefore be arranged at a suitable effective vertical distance from the weaving machine, without thereby predetermining the vertical position of the air channel 116. Moreover, appropriately shaped connection pieces also allow a lateral offset of the air channel 116 relative to the outlets, the specific lateral position of which is predetermined by the desired direction of the displacement flow.

Figure 4:
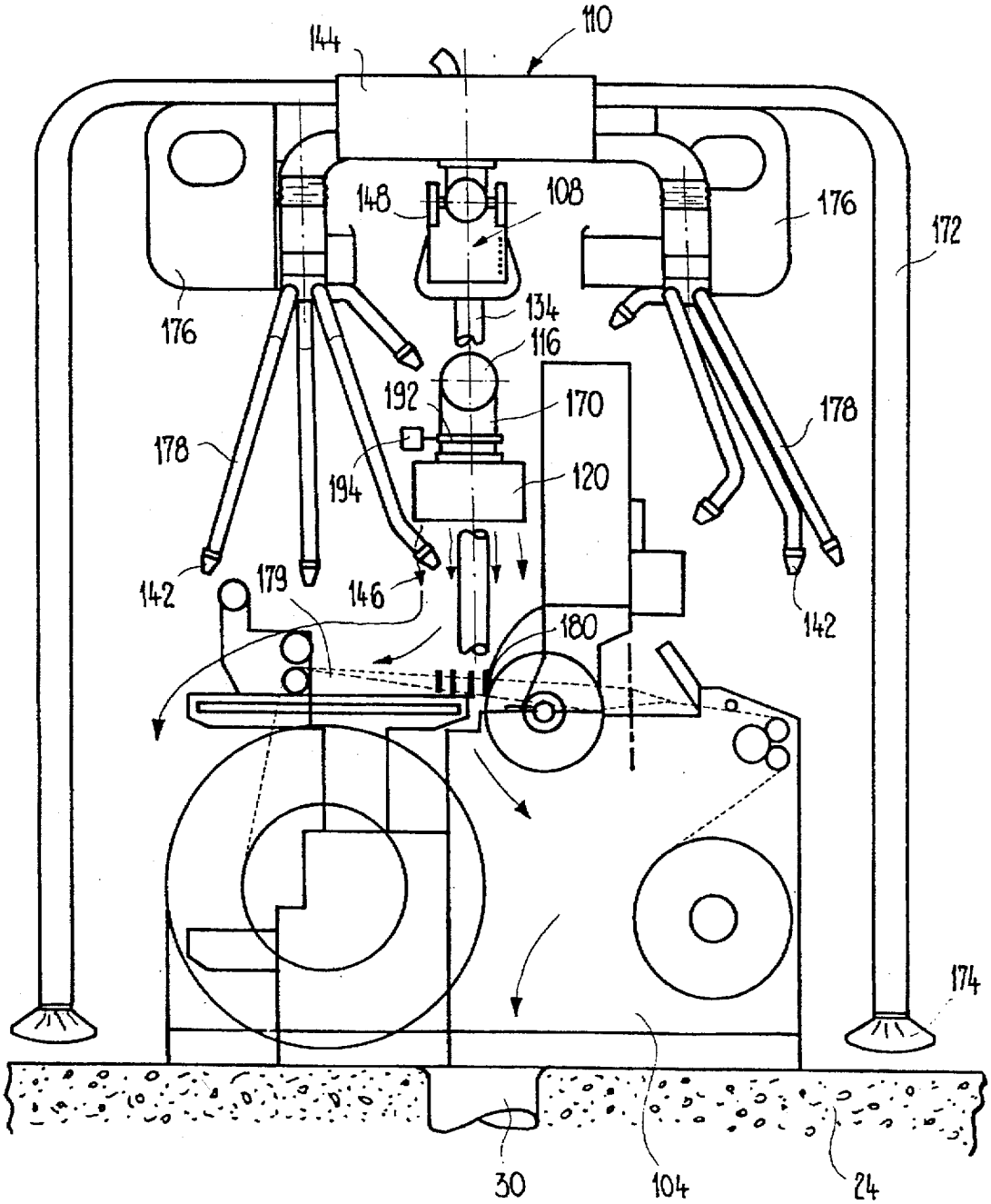
FIG. 4 shows a second exemplary embodiment in a representation corresponding to that of FIG. 3.

A further difference from the previously described exemplary embodiment is, that in the embodiment according to FIG. 4, the travelling cleaner 110 is both a blowing and a suction cleaner. For this purpose, suction arms 172, which carry suction members 174 arranged near the floor, are connected to the suction side of the fan 144. For impurities sucked up and separated from the air stream, collecting boxes 176 are assigned in a manner known in the art to the fan 144. The blowing nozzles 142 are connected to the fan 144 via blowpipe-like members 178.

For operating the apparatus, it can be expedient if the piston-flow outlets allow an individual adjustment of the volume, this being possible by means of the throttle member 192 indicated in FIG. 4 and located in the connection piece 170. The throttle member 192 can also be suitable for completely interrupting the flow of air to the outlet when the machine is stopped. Both adjustment and interruption can take place via an actuating or regulating member which is designated by 194 and which, if appropriate, is part of a process control incorporating the apparatus.

The weaving machine 104 according to FIG. 4 is an air-jet weaving machine, but, here too, the displacement flow 146 is oriented opposite to the warp 179 for partially directly covering the back shed 180.

Figure 5:
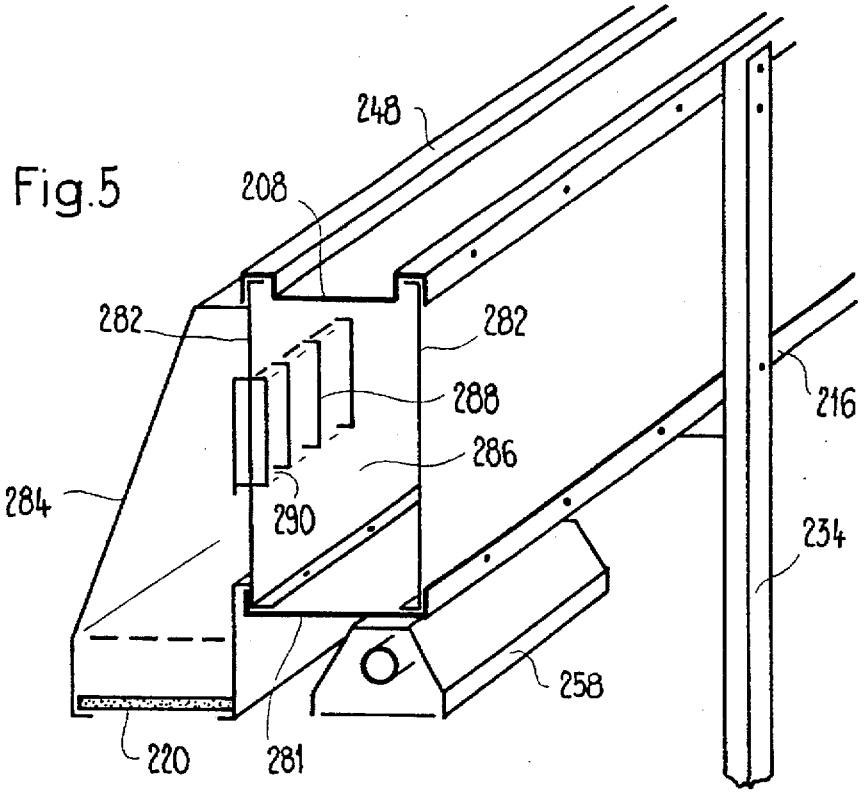
FIG. 5 shows a portion of an air channel from a third exemplary embodiment in a perspective representation.
Figure 6:
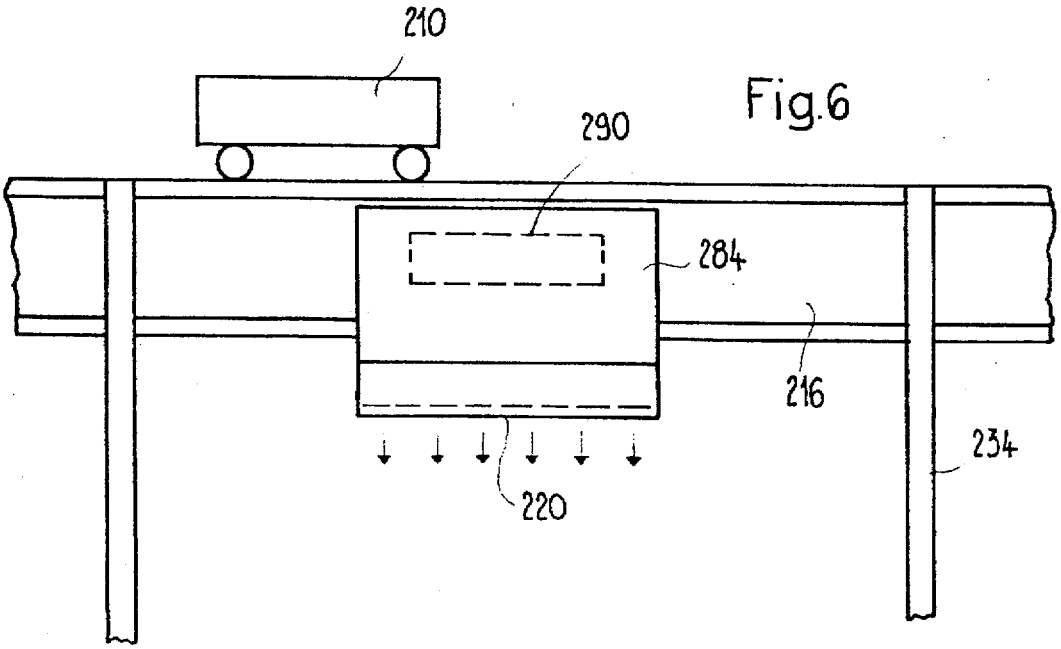
FIG. 6 shows a partial side view of the third exemplary embodiment in FIG. 5.

FIGS. 5 and 6 illustrate an alternative air channel. The air channel 216 of rectangular cross-section has horizontal narrow sides 281 (upper one not shown) and vertical wide sides 282. Mounted on the wide side 282 located on the left in the drawing is an outlet box 284. This has a downward-directed piston-flow outlet 220 and is connected to the interior 286 of the air channel 216 via a slit-shaped passage orifice 290 occupied by deflecting elements 288.

Once again, the rails 248 of the runway 208, on which the travelling cleaner indicated at 210 moves, are integrally formed on the upper narrow side of the air channel 216. Light fixtures 258 are fastened on the lower narrow side 281 to the air channel 216 which also forms a carrier here. The air channel 216 is itself held on stays 234.

Of course, the rails forming the runway of the travelling cleaner can also be designed as parts which are independent of the air channel and which are reinforced as a result of a corresponding connection to this channel.

It is usually expedient to use the apparatus for generating the machine climate suitable in terms of moisture and temperature for the particular special fabrication process or the fabricated material. However, this function can also be left to a separate air-conditioning system. On the other hand, in many instances, there is no need for any other air-conditioning in the room if the apparatus according to the invention is designed appropriately. Some of the conditioning air discharged via the piston-flow outlets must, in this case, be provided for directly influencing the room climate. Although the requirements of a climate suitable both for the attendants and for the fabrication process are met, substantial savings as regards total energy consumption can thereby be achieved.

The apparatus according to the invention can, while achieving comparable results, be used on other textile machines in which lint and dust are released as a result of the fabrication process. This applies especially to machines which serve for the spinning process.

What is claimed is:

1. An apparatus for influencing ambient conditions of textile machines comprising:

a runway extending above the textile machines;

at least one travelling cleaner having means for moving on the runway;

an air channel extending parallel to the runway which, for each said textile machine, has at least one stationary downward-directed piston-flow outlet arranged at a predetermined distance above a work zone of each said textile machine, said air channel being connected to an air-conditioning system; and exhaust-air ports for each textile machine located in a floor below said textile machine and connected to a suction channel.

2. Apparatus according to claim 1, wherein the runway of the travelling cleaner is formed by rails which are supported jointly with the air channel.

3. Apparatus according to claim 1 or 2, wherein the at least one piston-flow outlet is formed on the air channel.

4. Apparatus according to claim 3, wherein each piston-flow outlet of said at least one piston-flow outlet is preceded by at least one of a throttle member and a closing member.

5. Apparatus according to claim 3 wherein the suction channel is also connected to the air-conditioning system.

6. Apparatus according to claim 1, wherein the runway of the travelling cleaner is provided directly on the air channel and is supported jointly with the air channel, and the at least one piston-flow outlet is formed by outlet boxes provided on a wall of the air channel.

7. Apparatus according to claim 6, wherein the air channel forms rails as the runway for the travelling cleaner.

8. Apparatus according to claim 6 or 7, wherein busbars for driving the travelling cleaner are provided on the air channel.

9. Apparatus according to claim 8 wherein the air channel further includes structure for mounting light fixtures thereon, a duct for carrying a cable which supplies a current to the textile machines, and a compressed-air conduit which supplies compressed air to the textile machines.

10. Apparatus according to claim 8 wherein the suction channel is also connected to the air-conditioning system.

11. Apparatus according to claim 6 or 7 wherein the air channel further includes structure for mounting light fixtures thereon, a duct for carrying a cable which supplies a current to the textile machines, and a compressed-air conduit which supplies compressed air to the textile machines.

12. Apparatus according to claim 11 wherein the suction channel is also connected to the air-conditioning system.

13. The apparatus of claim 1 wherein said means for moving said at least one travelling cleaner includes one or more rollers rotatably mounted to each of said at least one travelling cleaner for rollably supporting each of said at least one travelling cleaner with respect to said runway.

14. Apparatus according to claim 1, 2, 4, or 5 wherein the suction channel is also connected to the air-conditioning system.

15. The apparatus of claim 1 wherein said at least one travelling cleaner is coupled with an air source independent from said air channel.

16. A forced air cleaning system for cleaning a plurality of objects, said system comprising:

an air channel for transporting a first supply of air from a forced air source, said channel having a plurality of stationary outlets for directing at least a portion of said first supply of air as an air flow at each of said objects; and a traveling cleaning apparatus having means for translating past each of said plurality of objects along a track formed by said air channel, said traveling cleaning apparatus further having means for generating and directing a second supply of air at each of said plurality of objects for cleaning each of said plurality of objects as said traveling cleaning apparatus passes.

17. The system of claim 16 further comprising a plurality of suction ports connected to a vacuum channel for ingesting debris dislodged from said objects by said air flow and said second supply of air at least a one of said suction ports being disposed adjacent each of said objects.

18. The system of claim 15 wherein said means for translating includes one or more rollers rotatably mounted to said traveling cleaning apparatus for rollably supporting said travelling cleaning apparatus with respect to said track.

19. A forced air cleaning system for cleaning a plurality of objects, said system comprising:

an air channel for transporting a supply of air from a forced air source, said channel having a circumferentially closed hollow profile and including a plurality of discrete openings formed therein for directing at least a portion of said supply of air at each of said plurality of objects, said openings being disposed in spaced relation along the length of said air channel at one side thereof;

a runway fixed to said air channel along a side thereof opposite to the side at which said openings are disposed; and a travelling cleaning apparatus having means for translating past each of said plurality of objects along said runway, said travelling cleaning apparatus pneumatically cleaning each of said plurality of objects as said travelling cleaning apparatus passes thereby.

20. The system of claim 19 wherein said means for translating includes one or more rollers rotatably mounted to said traveling cleaning apparatus for rollably supporting said travelling cleaning apparatus with respect to said runway.

21. A forced air cleaning system for cleaning a plurality of objects, said system comprising:

an air channel for transporting a first supply of air from a forced air source, said channel having a plurality of outlets for directing at least a portion of said first supply of air as an air flow at each of said objects; and a traveling cleaning apparatus having means for translating past each of said plurality of objects along a track formed by said air channel, wherein said traveling cleaning apparatus comprises at least one air conduit for transporting a second supply of air from a fan that is translatable with said traveling cleaning apparatus to at least one nozzle attached to said conduit for directing said second supply of air as at least one concentrated air flow at each of said plurality of objects as said traveling cleaning apparatus passes each said object.

* * * * *